US007784371B2

(12) United States Patent
Hasegawa et al.

(10) Patent No.: US 7,784,371 B2
(45) Date of Patent: Aug. 31, 2010

(54) STARTER

(75) Inventors: Youichi Hasegawa, Kasugai (JP); Sadayoshi Kajino, Nagoya (JP); Tomoya Imanishi, Kariya (JP)

(73) Assignee: Denso Corporation, Kariya (JP)

( * ) Notice: Subject to any disclaimer, the term of this patent is extended or adjusted under 35 U.S.C. 154(b) by 1019 days.

(21) Appl. No.: 11/509,640

(22) Filed: Aug. 25, 2006

(65) Prior Publication Data

US 2007/0068288 A1 Mar. 29, 2007

(30) Foreign Application Priority Data

Sep. 22, 2005 (JP) ..... 2005-276708

(51) Int. Cl.
*F02N 15/00* (2006.01)
*F02N 15/04* (2006.01)
*F02N 15/06* (2006.01)
*F02N 15/02* (2006.01)

(52) U.S. Cl. ..... 74/7 A; 74/7 R; 74/7 E

(58) Field of Classification Search ..... 74/6, 74/7 A, 7 C, 7 E, 7 R
See application file for complete search history.

(56) References Cited

U.S. PATENT DOCUMENTS 4,579,010 A * 4/1986 Colvin et al. ..... 74/7 A
5,307,700 A * 5/1994 Spellman et al. ..... 74/7 A
5,341,697 A * 8/1994 Isozumi ..... 74/7 A
5,688,203 A 11/1997 Yamamoto et al.
5,796,172 A * 8/1998 Morisita et al. ..... 290/48

FOREIGN PATENT DOCUMENTS

| | | |
|---|---|---|
| GB | 2 042 089 A | 9/1980 |
| JP | A-55-107065 | 8/1980 |
| JP | A-S63-016168 | 1/1988 |
| JP | A-S63-129165 | 6/1988 |
| JP | A-H05-126018 | 5/1993 |
| JP | A-8-291783 | 11/1996 |
| JP | A-2003-328912 | 11/2003 |
| JP | A 2005-133606 | 5/2005 |

OTHER PUBLICATIONS

Jun. 2, 2009 Notification of Reasons for Rejection for Japanese Patent Application No. 2005-276708.
Notification of Reasons for Rejection mailed Jan. 5, 2010 for Japanese Patent Application No. 2005-276708 (and translation).

* cited by examiner

*Primary Examiner*—Thomas R Hannon
*Assistant Examiner*—Justin Krause
(74) *Attorney, Agent, or Firm*—Oliff & Berridge, PLC

(57) ABSTRACT

A starter and a method of manufacturing the starter are disclosed wherein the starter comprises a case, a housing disposed in front of the case, a pinion moving body slidably received by the case and the housing, and a lever unit having a lever, swingably supported on a lever support member, for actuating the pinion moving body to an operative position to allow a pinion to be brought into meshing engagement with a ring gear of an engine to start up the same. The lever support member is mounted on the case via a positioning mechanism composed of positioning components, formed on the lever support member, and the positioning components, formed on the case, with which the positioning components engage, respectively.

13 Claims, 4 Drawing Sheets

STARTER

CROSS REFERENCE TO RELATED APPLICATIONS

This application is related to Japanese Patent Application No. 2005-276708 filed on Sep. 22, 2005, the contents of which are hereby incorporated by reference.

BACKGROUND OF THE INVENTION

1. Technical Field of the Invention

The present invention relates to starters for starting up engines and methods of assembling the starters and, more particularly, a starter with a two-shaft structure, wherein a rotary shaft of a motor and an actuating shaft of an electromagnetic switch are placed in parallel to each other and which includes a case having a reduction gear accommodating section for accommodating a reduction gear section adapted to reduce a rotational speed of a motor and a switch accommodating section for accommodating the electromagnetic switch, and a method of manufacturing the starter.

2. Description of the Related Art

Attempt has heretofore been made in the related art to provide a starter of a two-shaft type wherein a rotary shaft of a motor and an actuating shaft of an electromagnetic switch are placed in parallel to each other. The starter of such a structure is usually comprised of a first case having a reduction gear accommodating section, in which a reduction gear section adapted to reduce a rotational speed of a motor is accommodated, and a second case having a switch accommodating section in which the electromagnetic switch is accommodated, with the first ad second cases being formed in separate structures and assembled to a front housing.

In the meanwhile, another attempt has been made to provide a starter including a single case having a reduction gear accommodating section, in which a reduction gear section adapted to reduce a rotational speed of a motor is accommodated, and a switch accommodating section, in which the electromagnetic switch is accommodated, which are integrally formed in a unitary structure as disclosed in Japanese Patent Laid-Open Publication No. 2005-133606. With the starter motor of such a structure, the reduction gear section and the electromagnetic switch are unitarily assembled to the front housing. This enables the starter to have advantageous effects of further improved vibration resistance to vibration of the electromagnetic switch than that of the related art structure while achieving reduction in the number of component parts constituting the starter.

However, with the starter disclosed in the related art, only the front housing is formed with an insertion recess for positioning a lever support member, playing a role as a fulcrum of a lever, which is driven when the electromagnetic switch is turned on. This results in an issue the occurrence of extremely difficult assembling work to assemble an actuating plunger of the electromagnetic switch and the lever upon engagement thereof.

To address such an issue, attempt has been made to adopt an assembling method including assembling a clutch and the lever engaging the clutch onto the front housing on an initial stage, preparing a preassembled structure with only the plunger being brought into engagement with the lever, assembling the electromagnetic switch to the front housing while inserting the plunger to the electromagnetic switch under a status before a mold cover, covering a stationary contact of the electromagnetic switch, is fixedly secured to the case, assembling the stationary contact to the electromagnetic switch, and subsequently assembling the mold cover to the electromagnetic switch. This assembling method results in an increase in the number of man-hours involving complicated assembling steps.

For another assembling method, also, an assembling method is conceived to assemble a starter by preparing a preassembled structure of an electromagnetic switch with component parts such as a mold cover being completely assembled. With such an assembling method, however, if attempt is made to allow a joint of the plunger, protruding from the electromagnetic switch in a preassembled state, and a lever to engage each other and render a clutch and the lever to be brought into an engaging status, a plunger is caused to protrude to a forward end position due to the action of a return spring and, therefore, a lever support member is raised into a free status. No position of the lever support member is fixed, causing an issue to occur on a subsequent stage with a difficulty of assembling the lever support member to an insertion recess formed in a front housing.

Furthermore, the lever has an engagement portion, to be held in engagement with a pinion moving body, which is formed in a U-shape configuration. This configuration has a structure that is hard to be firmly jointed to the pinion moving body and, therefore, the engagement portion tends to disengage from the pinion moving body. Additionally, since no position of the lever support member is fixed as mentioned above, a difficulty is encountered on a subsequent stage to assemble the lever support member to the insertion recess formed in the front housing.

SUMMARY OF THE INVENTION

The present invention has been completed with a view to addressing the above issues and has an object to provide a starter, having a case integrally formed with a reduction gear accommodating section and a switch accommodating section, which can easily assemble a lever unit operative to be driven by an actuating shaft of an electromagnetic switch for shifting a pinion into meshing engagement with a ring gear of an engine while permitting the ring gear to rotate for startup of the engine upon operation of a motor.

According to one aspect of the present invention, there is provided a starter for starting up an engine having a ring gear, comprising a case formed in a unitary structure having a reduction gear unit accommodating section, for accommodating therein a reduction gear section operative to reduce a rotational speed of a motor, and a switch accommodating section, for accommodating therein an electromagnetic switch having a plunger whose front end protrudes from the case. A housing supports the case such that the case is sandwiched between the housing and the motor. A lever unit includes a lever, having one end held in engagement with the front end of the plunger, and a lever support member mounted on the case for swingably supporting the lever, the lever unit being actuated by the electromagnetic switch to selectively move the lever in inoperative and operative positions. A pinion moving body carries thereon a pinion and is held in engagement with the other end of the lever to be actuated by the lever unit when the electromagnetic switch is operated to allow the pinion to be brought into meshing engagement with the ring gear of the engine to transfer an output torque of the reduction gear section to the ring gear for thereby starting up the engine. One of opposing surfaces of the lever support member and the case has at least one positioning projection and the other one of the opposing surfaces of the lever support member and the case has at least one positioning depressed portion with which the positioning projection engages to allow the lever support member to be positioned with respect to the case.

With the starter of such a structure, engaging the at least one positioning projection, formed on one of the opposing surfaces of the lever support member and the case, with the at least one positioning depressed portion, formed on the other one of the opposing surfaces of the lever support member and the case enables the lever support member to be positioned with respect to the case. This results in capability of easily assembling the lever support member to the case. That is, first, the reduction gear section is accommodated in the reduction gear accommodating section of the case and the electromagnetic switch is accommodated in the switch accommodating section as a trial assembly involving the plunger (additionally inclusive of contacts and a mold cover shielding the contacts). Subsequently, the pinion moving body is assembled to the case. Next, with the lever support member being mounted to the lever, the one end of the lever is coupled to the front end of the plunger that protrudes from the case, while engaging the other end of the lever to the pinion moving body. Thereafter, the at least one positioning projection, provided on one of the opposing surfaces of the lever support member and the case, is brought into engagement with the at least one positioning depressed portion provided on the other one of the opposing surfaces of the lever support member and the case. This allows the lever unit to be assembled to the case under a trial assembly closer to a legitimate assembly state, upon which the housing can be assembled to the trial assembly in an easy fashion within the shortest period of time.

With the starter mentioned above, the positioning projection and the positioning depressed portion may be operative to restrict the lever support member from rotating about a center axis thereof.

With such a structure, the engagement between the positioning projection and the positioning depressed portion restricts the lever support member from rotating about the center axis thereof. This enables the lever support member to be positioned on the case not to cause a twisted attitude during assembly of the housing, providing a further ease of assembling workability.

With the starter, the positioning projection may comprise a plurality of positioning components, formed on the one of the opposing surfaces of the lever support member and the case, and the positioning depressed portion comprises a plurality of depressed components, formed on the other one of the opposing surfaces of the lever support member and the case, which are engageable with the plurality of positioning components, respectively.

With such a structure described above, the provision of the plurality of positioning components, formed on the one of the opposing surfaces of the lever support member and the case, and the plurality of depressed components, formed on the other one of the opposing surfaces of the lever support member and the case to be engageable with the plurality of positioning components, respectively, enables the engagement between the positioning components and the positioning depressed components at a plurality of engagement points. This results in capability of restricting the lever support member from rotating about the center axis thereof in a highly reliable manner.

With the starter of the present embodiment, the positioning projection and the positioning depressed portion may have no-circular shapes in cross section.

With such a structure set forth above, since the positioning projection and the positioning depressed portion have no-circular cross sections, the engagement between the positioning components and the positioning depressed components provides capability of restricting the lever support member from rotating about the center axis thereof in a highly reliable manner.

With the starter of the present embodiment, the electromagnetic switch may include a plunger having a front end protruding from the case, and an engagement state between the positioning projection and the positioning depressed portion may be established under a condition where the plunger assumes a forward end position.

With such a structure mentioned above, since the engagement state between the positioning projection and the positioning depressed portion is established under the condition where the plunger assumes the forward end position, the lever unit can be kept on the case in a trial assembly state even under a circumstance where the one end of the lever is held in engagement with the front end of the plunger and the other one end of the lever is held in engagement with the pinion moving body. This provides capability of assembling the housing to the case in an easy fashion.

With the starter of the present embodiment, the lever unit may further include an annular engagement member through which the lever is coupled to the pinion moving body.

With such a structure noted above, permitting the engagement between the lever and the pinion moving body by means of the annular engagement member allows an inner periphery of the annular engagement member to be brought into coupling engagement with the pinion moving body under a status where the plunger is caused not to move to the forward end position. This minimizes the amount of a lift of the lever support member from the case, resulting in a reduction of a longitudinal length in engagement between the positioning projection and the positioning depressed portion to connect the lever support member to the case. Also, assembling work can be performed with no disengagement between the lever and the pinion moving body. Thus, the starter can be assembled in further improved assembling workability.

With the starter of the present embodiment, the housing may have an inner wall formed with an insertion recess to which the lever support member is inserted for positioning the same in a fixed place.

With such a structure, in addition to the advantageous effect in that the lever support member is positioned to the case with a structure permitting the engagement between at least one positioning projection, formed on one of the opposing surfaces of the lever support member and the case, and at least one positioning depressed portion formed on the other one of the opposing surfaces of the lever support member and the case, the provision of the insertion recess formed on the inner wall of the housing for receiving the lever support member for the positioning thereof enables the lever support member to be inserted to the insertion recess of the housing for the positioning. This results in an increase in reliability of positioning the lever support member in a fixed place with respect to the case and the housing.

Another aspect of the present invention provides a starter for starting up an engine having a ring gear. The starter comprises a case formed in a unitary structure having a reduction gear unit accommodating section, for accommodating therein a reduction gear section operative to reduce a rotational speed of a motor, and a switch accommodating section, for accommodating therein an electromagnetic switch having a plunger whose front end protrudes from the case. A housing supports the case such that the case is sandwiched between the housing and the motor. A lever unit includes a lever, having one end held in engagement with the front end of the plunger, and a lever support member mounted on the case for swingably supporting the lever, the lever unit being actuated by the electromagnetic switch to selectively move the lever in inoperative and operative positions. A pinion moving body carries thereon a pinion and held in engagement with the other end of the lever to be actuated by the lever unit when the electromagnetic switch is operated to allow the pinion to be brought into meshing engagement with the ring gear of the engine to transfer an output torque of the reduction gear section to the ring gear for thereby starting up the engine. A positioning mechanism is disposed between the lever support member and the case to maintain the lever support member on the case in a predetermined positioned status.

With the starter of such a structure, the provision of the positioning mechanism between the lever support member and the case results in capability of easily assembling the lever support member to the case in a positioned state with high reliability. That is, first, the reduction gear section is accommodated in the reduction gear accommodating section of the case and the electromagnetic switch is accommodated in the switch accommodating section as a trial assembly involving the plunger (additionally inclusive of contacts and a mold cover shielding the contacts). Subsequently, the pinion moving body is assembled to the case. Next, with the lever support member being mounted to the lever, the one end of the lever is coupled to the front end of the plunger that protrudes from the case, while engaging the other end of the lever to the pinion moving body. Thereafter, the lever support member is mounted to the case through the positioning mechanism. This allows the lever unit to be assembled to the case under a trial assembly closer to a legitimate assembly state, upon which the housing can be assembled to the trial assembly in an easy fashion within the shortest period of time.

With the starter of the present embodiment, the case may include a positioning mount wall in opposition to the lever support member and the positioning mechanism may comprise a first positioning member, disposed on the lever support member, and a second positioning member, disposed on the positioning mount wall of the case, with the first and second positioning members being held in engagement with each other for positioning the lever support member with respect to the positioning mount wall of the case.

With such a structure described above, due to the provision of the lever support member having the first positioning member and the positioning mount wall of the case having the second positioning member, the lever support member can be mounted onto the positioning mount wall of the case through engagement between the first and second positioning members. This enables the lever support member to be fixed to the case in a positioned state with high reliability. Therefore, the case and the lever support member together with the reduction gear section and the electromagnetic switch can be arranged in a trial assembly in a compact and minimized size with the resultant ease of assembling the housing to the trial assembly.

With the starter of the present embodiment, further, the first positioning member may comprise at least one positioning projection and the second positioning member may comprise at least one positioning depressed portion with which the at least one positioning projection engages.

With such a structure mentioned above, the provision of the first and second positioning members composed of at least one positioning projection and at least one positioning depressed portion, respectively, results in a simple structure of the positioning mechanism.

With the starter of the present embodiment, furthermore, the positioning mechanism may allow the lever support member and the case to be held in an engagement state under a condition where the plunger of the electromagnetic switch protrudes to a forward end position.

With such a structure, since the lever support member can be mounted to the case in a positioned state under the condition where the plunger of the electromagnetic switch protrudes to the forward end position, the lever unit can be coupled to the pinion moving body in an easy fashion.

With the starter of the present invention, the positioning mechanism may allow the lever support member and the case to be held in an engagement state under a condition where the plunger of the electromagnetic switch protrudes to a forward end position in engagement with one end of the lever and the other end of the lever is held in engagement with the pinion moving body.

With such a structure, since the lever support member is held in engagement with the case under the condition where the plunger of the electromagnetic switch protrudes to the forward end position in engagement with one end of the lever and the other end of the lever is held in engagement with the pinion moving body, a trial assembly of the case, the lever unit and the pinion moving body can be sustained with high reliability, resulting in an increase in assembling workability.

Another aspect of the present invention provides a starter for starting up an engine having a ring gear, comprising a case having a unitary structure formed with a reduction gear unit accommodating section, for accommodating therein a reduction gear section operative to reduce a rotational speed of a motor, and a switch accommodating section for accommodating therein an electromagnetic switch including a plunger having a front end protruding forward from the case. A housing is disposed in front of the case so as to sandwich the case between the housing and the motor. A lever unit includes a lever, having one end held in engagement with the front end of the plunger in an area between the case and the housing, and a lever support member mounted on the case for swingably supporting the lever, the lever unit being operative to selectively move the lever in inoperative and operative positions. A pinion moving body, carrying thereon a pinion, is held in engagement with the other end of the lever and operative to axially move when the electromagnetic switch is operated to allow the pinion to be brought into meshing engagement with the ring gear of the engine to transfer an output torque of the reduction gear section to the ring gear for thereby starting up the engine. A first positioning element is provided on the lever support member at a rear end face thereof and a second positioning element is provided on the case at a surface facing the rear end face of the lever support member. The first and second positioning elements are held in engagement with each other to maintain the lever support member on the case in a positioned status.

Another aspect of the present invention provides a starter for starting up an engine having a ring gear, comprising case means having a unitary structure formed with a reduction gear unit accommodating section, for accommodating therein a reduction gear section operative to reduce a rotational speed of a motor, and a switch accommodating section for accommodating therein an electromagnetic switch including a plunger having a front end protruding forward from the case means. The housing means is disposed in front of the case means so as to sandwich the case means between the housing means and the motor. A lever unit includes a lever, having one end held in engagement with the front end of the plunger in an area between the case means and the housing means, and a lever support member mounted on the case for swingably supporting the lever, the lever unit being operative to selectively move the lever in inoperative and operative positions. A pinion moving body, carrying thereon a pinion, is held in engagement with the other end of the lever and operative to axially move when the electromagnetic switch is operated to allow the pinion to be brought into meshing engagement with the ring gear of the engine to transfer an output torque of the reduction gear section to the ring gear for thereby starting up the engine. The first positioning means is provided on the lever support member at a rear end face thereof and the second positioning means is provided on the case at a surface facing the rear end face of the lever support member. The first and second positioning means are held in engagement with each other to maintain the lever support member on the case in a fixedly positioned status.

Another aspect of the present invention provides a method of manufacturing a starter for startup of an engine having a ring gear, the method comprising preparing a case having a unitary structure formed with a reduction gear unit accommodating section, for accommodating therein a reduction gear section operative to reduce a rotational speed of a motor, and a switch accommodating section for accommodating therein an electromagnetic switch including a plunger having a front end protruding forward from the case, preparing a housing to be associated with the case, preparing a lever unit including a lever, having one end held in engagement with the front end of the plunger in an area between the case and the housing, and a lever support member for swingably supporting the lever, the lever unit being operative to selectively move the lever in inoperative and operative positions, and preparing a pinion moving body, carrying thereon a pinion, and operative to axially move when the electromagnetic switch is operated to allow the pinion to be brought into meshing engagement with the ring gear of the engine to transfer an output torque of the reduction gear section to the ring gear for thereby starting up the engine. A trial assembly is prepared by assembling the case, the reduction gear section mounted in the reduction gear unit accommodating section of the case, the electromagnetic switch mounted in the switch accommodating section of the case, the lever unit mounted on the case through a positioning mechanism, and the pinion moving body operatively coupled to the motor. The positioning mechanism is held in engagement with both the lever support member and the case so as to prevent the lever support member from twisting with respect to the case during the trial assembly under a condition where the plunger remains in a forward end position and one end of the lever is held in engagement with the front end of the plunger while the pinion moving body is held in engagement with the other end of the lever. The housing is assembled to the trial assembly under a status where the front end of the plunger assumes the forward end position.

With the method of assembling the starter according to the present invention, the preparing the housing may comprise forming an insertion recess on an inner wall of the housing and further comprising inserting the lever support member of the lever unit through the insertion recess of the housing to position the trial assembly with respect to the housing during complete assembly.

With the method of assembling the starter according to the present invention, further, the positioning mechanism comprises first positioning means provided on the lever support member at a rear end face thereof, and second positioning means provided on the case at a front surface facing the rear end face of the lever support member. The first and second positioning means may be held in engagement with each other to position the lever support member with respect to the case.

With the method of assembling the starter according to the present invention, the first positioning means may comprise at least one positioning element formed on the rear end face of the lever support member, and the second positioning means may comprise at least one positioning element formed on the front surface of the case.

With the method of assembling the starter according to the present invention, moreover, the positioning element of the first positioning means may comprise a plurality of positioning projections formed on the rear end face of the lever support member, and the positioning element of the second positioning means may comprise a plurality of positioning depressed portions formed on the front surface of the case and engageable with the plurality of positioning projections of the lever support member.

DETAILED DESCRIPTION OF PREFERRED EMBODIMENTS

Now, a starter of an embodiment according to the present invention is described below in detail with reference to the accompanying drawings.

Figure 1:
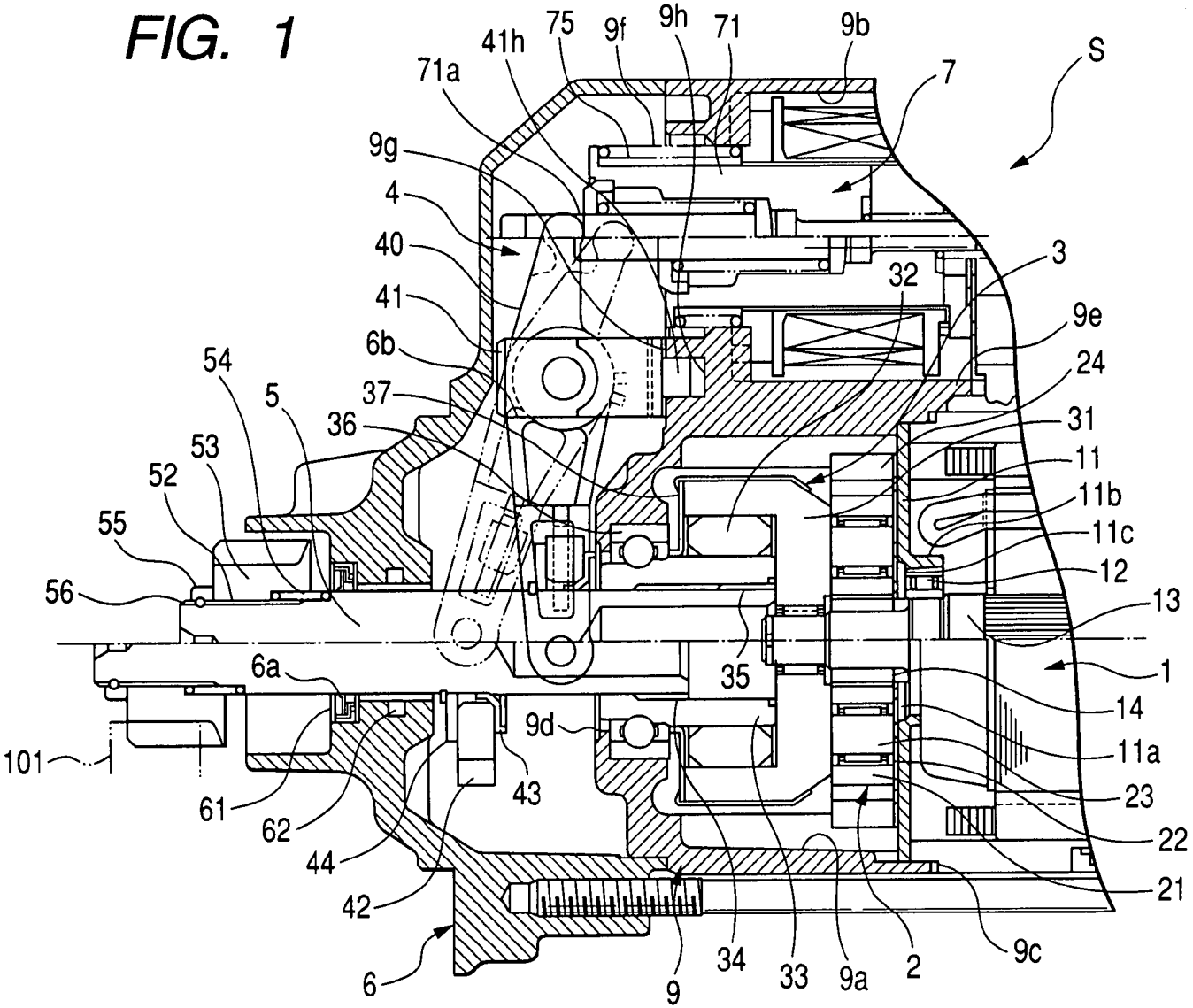
FIG. 1 is a cross-sectional view showing an essential part of a starter of one embodiment according to the present invention.
Figure 2:
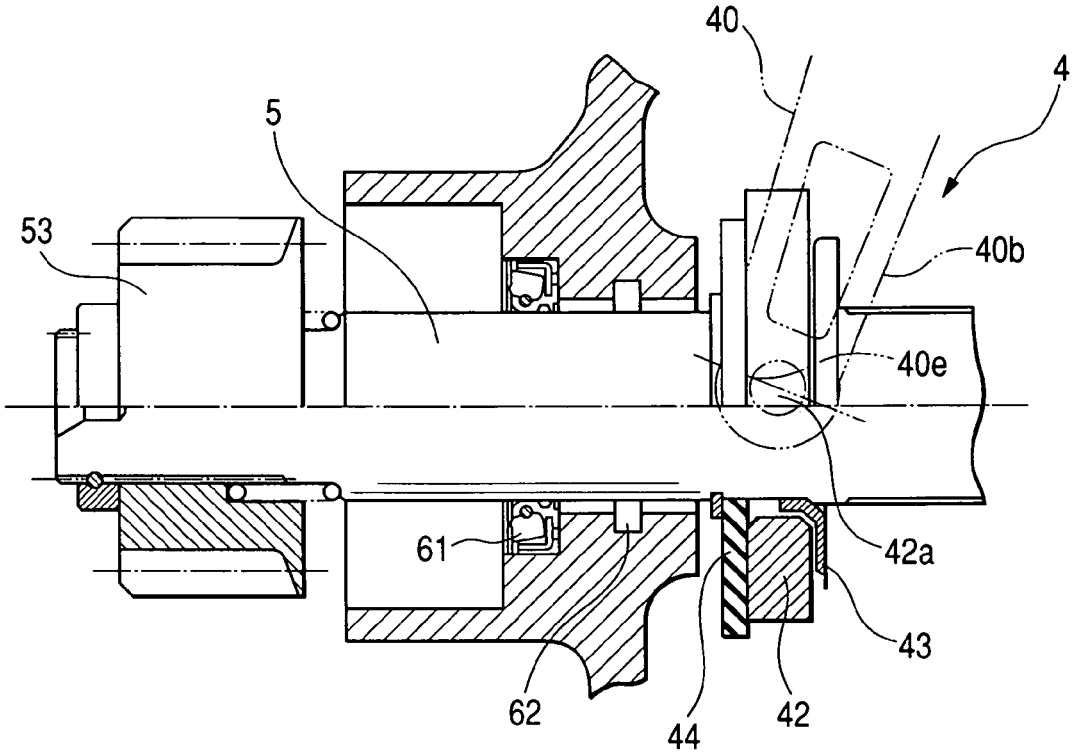
FIG. 2 is a side view showing an engagement structure, in an enlarged scale, between a lever unit and a clutch shaft.
Figure 3A:
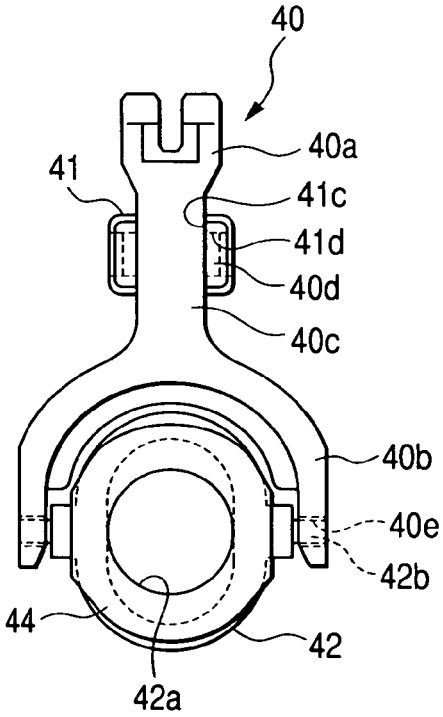
FIG. 3A is a front view showing the lever unit.
Figure 3B:
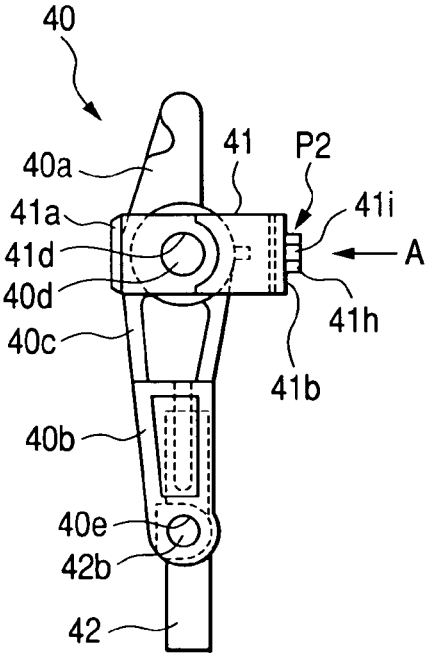
FIG. 3B is a side view showing the lever unit.
Figure 3C:
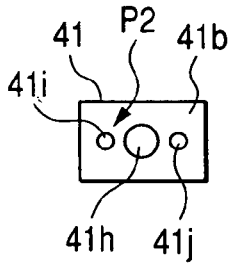
FIG. 3C is a view showing a lever collar as viewed in an arrow A in FIG. 3B.
Figure 4:
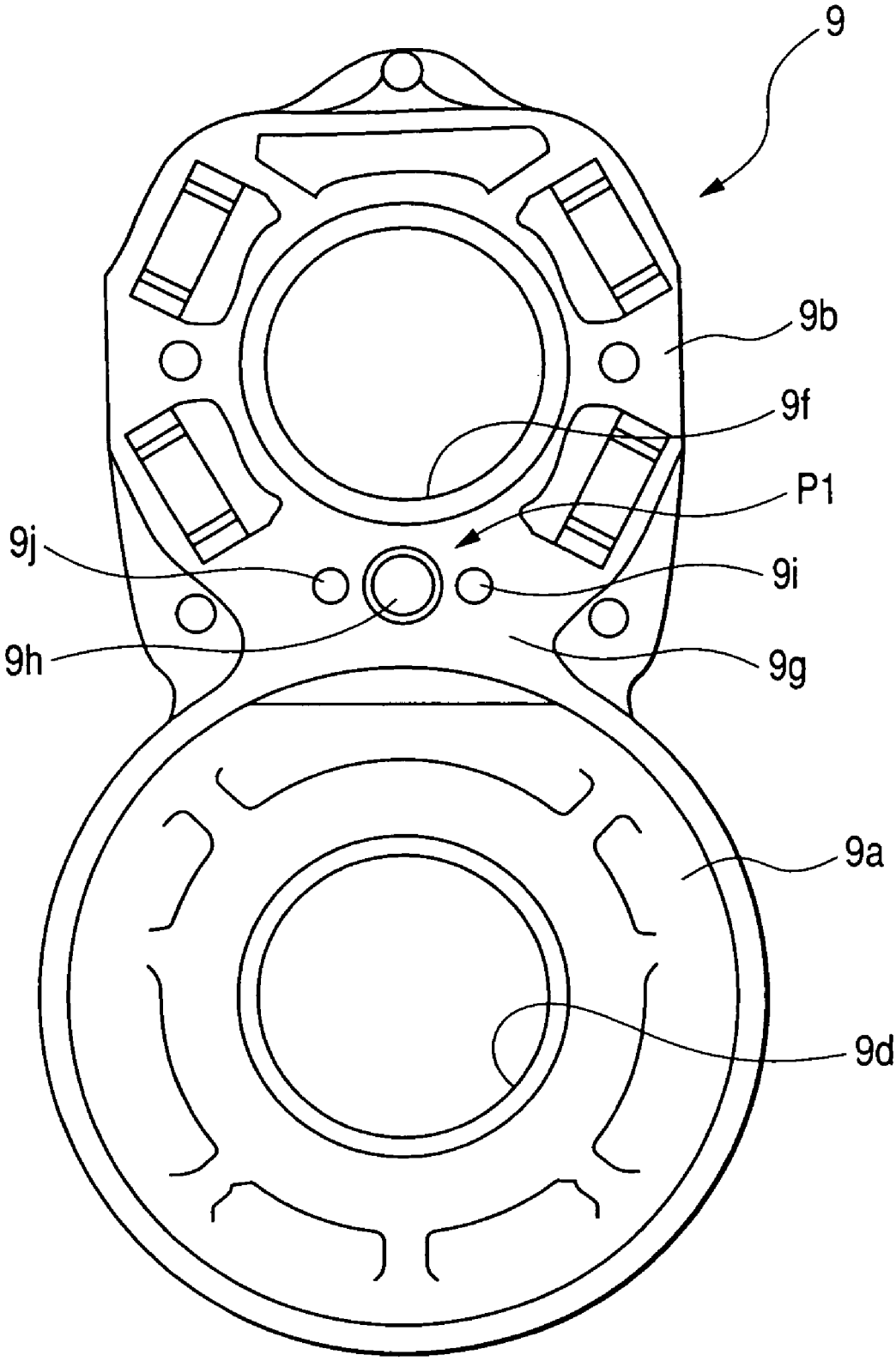
FIG. 4 is a front view of a case.
Figure 5:
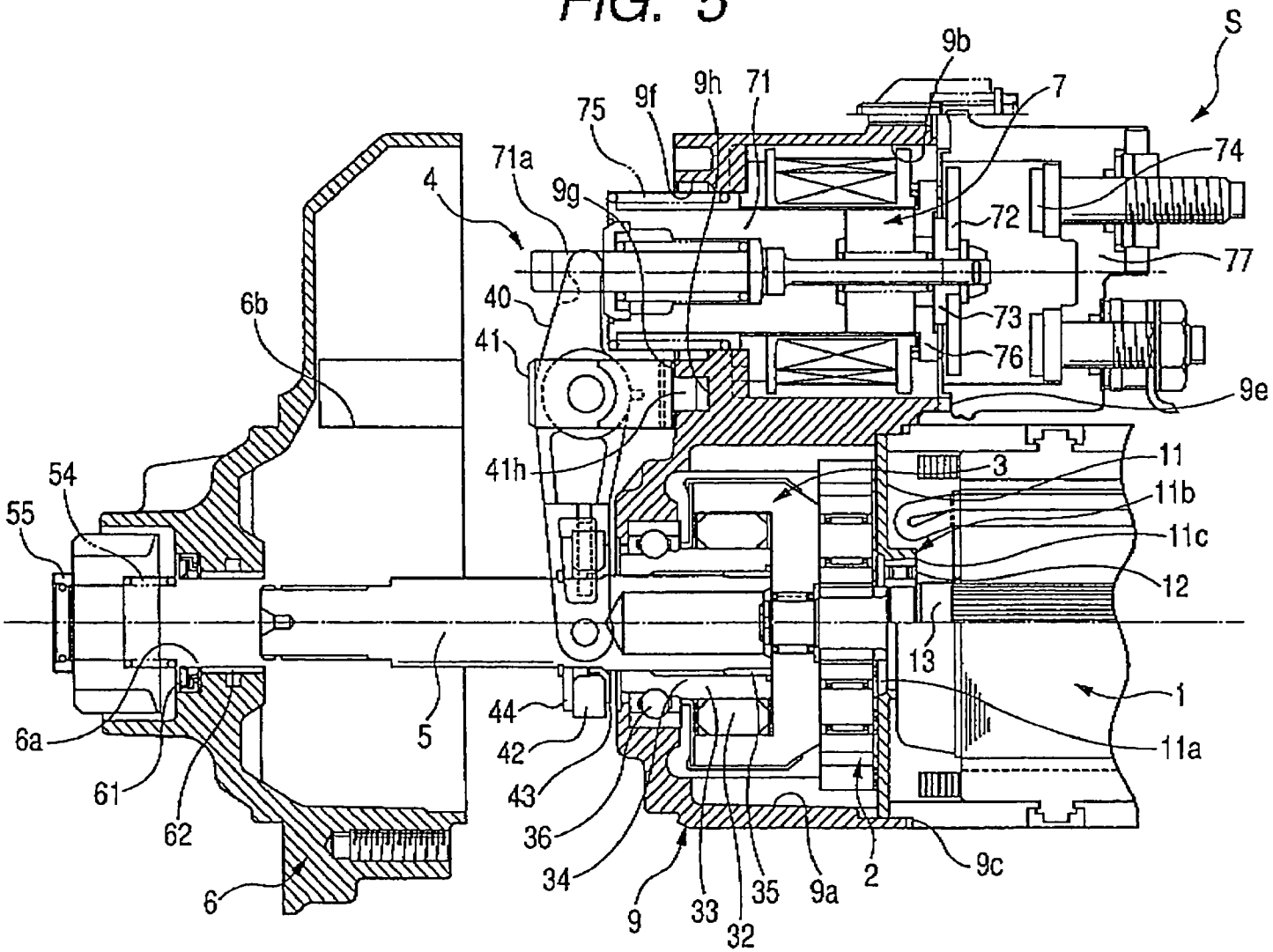
FIG. 5 is a cross-sectional view of a starter shown in a trial assembly before the trial assembly is assembled to a front housing.

FIG. 1 is a cross-sectional view of the starter S of the embodiment according to the present invention. FIG. 2 is a side view showing an engagement structure between a lever unit 4 and a clutch shaft 5 in an enlarged scale. FIG. 3A is a front view showing the lever unit 4; FIG. 3B is a side view of the lever unit 4; and FIG. 3C is a view showing a lever collar 41 as viewed in a direction along an arrow A in FIG. 3B. FIG. 4 is a front view of a case 9. FIG. 5 is a cross-sectional view of a front housing 6 shown in a trial assembly prior to completely assembling the same to a front housing.

Also, FIG. 1 shows a clutch shaft 5 remaining in an inoperative position in an upper area of a center line in which a pinion 53 remains under a non-protruding state and an operative position in a lower area of the center line in which the pinion 53 remains under a protruding state in meshing engagement with a ring gear 101 of an engine for startup of the same. Also, a plunger 71 of an electromagnetic switch 7 and a lever unit 4 are shown in FIG. 1 in phantom lines to designate these component parts being rendered to be operative, with solid lines indicating that these component parts are rendered inoperative.

As shown in FIG. 1, the starter S takes the form of a two-shaft structure wherein an armature shaft 13, playing a role as a rotary shaft of a motor section 1, and the plunger 71, playing a role as an actuating plunger of the electromagnetic switch 7, are disposed in parallel to each other. The starter S takes the form of a housing structure comprised of two halves, separated in an axial direction, which comprise a case 9 for accommodating therein a planetary reduction gear unit 2 and the electromagnetic switch 7 and a front housing 6 by which the case 9 is sandwiched with respect to the motor section 1. Also, the front housing 6 plays a role as a housing according to the present invention.

As shown in FIGS. 1 and 4, the case 9 takes the form of a housing that includes a reduction gear accommodating section 9*a* formed in a substantially cylindrical shape for accommodating therein the planetary reduction gear unit 2, playing a role as a reduction gear unit, to reduce a rotational speed of the armature shaft 13 and a switch accommodating section 9*b* formed in a substantially cylindrical shape for accommodating therein the electromagnetic switch 7, with the reduction gear accommodating section 9*a* and the switch accommodating section 9*b* being unitarily formed in structure. The reduction gear accommodating section 9*a* has a front end opening 9*d*, smaller in diameter than that of a rear end opening 9*c*, to which the clutch shaft 5 is inserted. Moreover, the switch accommodating section 9*b* has a front end opening 9*f*, smaller in diameter than that of a rear end opening 9*e*, to which the plunger 71 is inserted. That is, the electromagnet switch 7 is accommodated in the switch accommodating section 9*b* under a status where the plunger 71 has a distal end portion that protrudes forward of the front end opening 9*f*.

As shown in FIG. 4, the case 9 has a front end face 9*g*, formed between the reduction gear accommodating section 9*a* and the switch accommodating section 9*b* and placed in face-to-face relation with an inside of the front housing 6, which has a substantially central area including a positioning member P1. The positioning member P1 of the front end face 9*g* includes positioning components in the form of positioning depressed portions 9*h*, 9*i*, 9*j* adapted to position a lever collar 41 of the lever unit 4 in a manner that will be described below in detail.

The front housing 6, comprised of a housing member, is disposed in front of the starter S on a side closer to a mounting site (not shown) of the engine (not shown) and associated with the motor section 1 to sandwich the case 9. The front housing 6, having a rear end facing the case 9 and opening in a large size, has a through-bore 6*a*, through which the clutch shaft 5 extends, and a lever collar insertion recess 6*b* to which the lever collar 41 is inserted in a fixed position. Also, the lever collar insertion recess 6*b* plays a role as an insertion recess portion according to the present invention.

The reduction gear accommodating section 9*a* of the case 9 has an inner peripheral wall, to which an intermediate plate 11 is fixedly secured to block off the motor section 1 and the planetary reduction gear unit 2 from each other. The intermediate plate 11 is made from a circular-shaped plate-like member that has a central area formed with a shaft bore 11*a*. The intermediate plate 11 has one surface, facing the motor section 1, which is formed with an annular flange 11*b* axially extending so as to surround an entire periphery of the shaft bore 11*a*. Also, the intermediate plate 11 has the other surface, facing the planetary reduction gear unit 2, which is formed with a cup-shaped stopper portion 11*c*.

With such a structure, a bearing 12 is fitted to the annular flange 11*b* of the intermediate plate 11 on a side facing the motor section 1 until the bearing 12 is brought into abutting engagement with the cup-shaped stopper 11*c*, thereby restricting axial movement of the motor section 1 toward the planetary reduction gear unit 2. The intermediate plate 11 supports the armature shaft 13 by means of the bearing 12 fitted to the annular flange 11*b*.

The armature shaft 13 has a front end portion formed with an armature gear 14, playing a role as a sun gear, which is held in meshing engagement with planetary gears 21 of the planetary reduction gear unit 2. The planetary gears 21 are supported with support shafts 23 by means of bushes 22 and move around the armature gear 14, while rotating along a circular path between the armature gear 14 and an internal gear 24, to reduce the rotational speed of the armature gear 14 for thereby transferring output torque to a clutch outer 31 of a clutch 3 at a reduced speed. The clutch outer 31 transfers output torque to a tubular shaped clutch inner 33 via rollers 32.

The clutch inner 31 is coupled to a helical spline 35 of the clutch shaft 5 via a helical spline 34. The helical splines 34, 35 are held in meshing engagement with each other and the clutch shaft 5 is movable within the clutch inner 33 in sliding capability. Further, the helical spline 34 disposed in the clutch inner 33 is associated with the stopper 35 to be held in a stop position at an area radially inward of a bearing 36. Also, the clutch 3 and the clutch shaft 5 constitute a pinion moving body that forms part of the present invention.

The electromagnetic switch 7 is a known electromagnetic switch that opens or closes contacts disposed in a current circuit of the motor section 1. When a starter switch (not shown) is turned on, the electromagnetic switch 7 is energized to actuate the plunger 71 rearward in FIG. 1 and when the starter switch is turned off, the electromagnetic switch 7 is de-energized and a return spring 75 acts to restore the plunger 71 to its original stationary position.

The lever unit 4 plays a role as a device that is driven with the plunger 71, operative when the electromagnetic switch 7 is turned on, to cause the clutch shaft 5 to move in an axial direction to allow the pinion 53, carried at a front end of the clutch shaft 5, to be brought into meshing engagement with the ring gear 101 of the engine. The lever unit 4 is comprised of the lever 40, the lever collar 41, a lever ring 42, a ring washer 43 and a caulked ring washer 44. With the present embodiment, the lever collar 41 plays a role as a lever support member and the lever ring 42 plays a role as a circled annular engagement member.

As best shown in FIG. 3A, the lever 40 includes bifurcated head portions 40*a*, 40*a*, bifurcated leg portions 40*b*, 40*b*, and an interconnecting section 40*c* for interconnecting the bifurcated head portions 40*a* and the bifurcated leg portions 40*b*. Further, the interconnecting section 40*c* has a substantially central area whose both sides have laterally extending pivot shafts 40*d*, 40*d*. The bifurcated head portions 40*a*, 40*a* are held in engagement with a joint 71*a* provided at a forward end of the plunger 71 that protrudes through the opening 9*a* of the case 9. The bifurcated leg portions 40*b*, 40*b* have distal end neighborhoods formed with laterally extending through-bores 40*e*, 40*e*, respectively.

The lever collar 41 plays a role as a fulcrum to pivotally support the lever 40 for swinging capability. As shown in FIGS. 3A to 3C, the lever collar 41, made of resin or the like in a substantially cylindrical shape, has front end faces 41*a*, 41*a* facing an inner wall of the front housing 6 and a substantially central area formed with a slit 41*c* axially extending in a recessed shape. The slit 41*c* has a width slightly greater than a thickness of the interconnecting section 40*c* of the lever 40 and a depth determined not to cause interference against swinging movement of the lever 40. The lever collar 41 has both sides, placed in opposition to each other by means of the slit 41*c*, which are formed with through-bores 41*d*, 41*d* through which the protrusions 40*d*, 40*d* of the lever 40 extend to allow the lever collar 41 to pivotally support the lever 40.

Further, the lever collar 41 includes a positioning member P2 associated with the positioning member P1 of the case 9 to play a role as a positioning mechanism to position the lever collar 41 with respect to the front end face 9*g* of the case 9 to prevent the lever collar 41 from twisting during assembly of the starter S. More particularly, the positioning member P2 is provided on a rear end face 41*b* of the lever collar 41 and includes a positioning projection 41*h* formed at a central area of the rear end face 41*b* to have a circular shape in cross-section. The positioning member P2 further includes positioning projections 41*i*, 41*j*, formed at left and right sides of the positioning projections 41*h*, which have circular shapes in cross-section each with a smaller diameter than the positioning projection 41*h*. With such a structure, the positioning projections 41*h*, 41*i*, 41*j* are engageable with the positioning depressed portions 9*h*, 9*i*, 9*j* forming the positioning member P1 of the case 9 to allow the lever collar 41 to be positioned with respect to the front end face 9*g* of the case 9 in a highly reliable fashion.

The lever ring 42 plays a role as a circled annular engagement member formed with an insertion bore 42*a* to which the clutch shaft 5 is inserted. The lever ring 42 has both sides, axially spaced in opposition to each other with respect to a center of the lever ring 42, which are formed with laterally and outwardly extending protrusions 42*b*, 42*b*. The lever ring 42 is swingably supported by means of the protrusions 42*b*, 42*b* pivotally disposed in the through-bores 40*e*, 40*e* of the bifurcated leg portions 40*b*, 40*b* of the lever 40.

As shown in FIGS. 3A to 3C, further, the interconnecting section 40*c* is inserted through the slit 41*a* of the lever collar 41 to allow the projections 40*d*, 40*d* to be fitted to the through-bores 41*d*, 41*d* of the lever collar 41 and the lever 40 is swingably pivoted with a fulcrum on the projections 40*d*, 40*d*.

Furthermore, the front end face 41*a* of the lever collar 41 assumes a position between the front housing 6 and the case 9 and is held in abutting engagement with the inner wall of the front housing 6. Also, the plurality of positioning projections 41*h*, 41*i*, 41*j* are held in engagement with the positioning depressed portions 9*h*, 9*i*, 9*j*, respectively, formed on the front end face 9*g* of the case 9 to allow the rear end face 41*b* of the lever collar 41 to be positioned with respect to the case 9.

As best shown in FIG. 2, the clutch shaft 5 is inserted through the through-bore 42*a* and the ring washer 43 and the caulked ring washer 44 are fitted thereto in fixed places to allow the lever ring 42 to be brought into engagement with the clutch shaft 5.

The clutch shaft 5 is supported with a bush 62 of the housing 6 for sliding and rotating capabilities and driven by the lever unit 4 to be axially movable between a stationary position and an actuating position. A seal member 61 is fitted to a front end portion of the housing 6 to seal a front end of the bush 62.

Further, the pinion 53 is coaxially carried on the front end of the clutch shaft 5 and held in engagement with a straight spline 52. Also, the pinion 53 is held in place via a stop collar 55 and a snap ring 56 due to a pressing force of a pinion spring 54. The clutch inner 33 has a forward end, closer to the pinion 53, which has an outer diametric periphery playing a role as an inner race on which ball bearings are disposed to allow the clutch shaft 5 to be rotatably supported with a frame 37.

Now, the operation of the starter S is described below in connection to various component parts thereof.

As a starter switch (not shown) is turned on, the electromagnetic switch 7 is energized to move the plunger 71 rearward in a position remote from the engine, that is, rightward in FIG. 1, causing the lever 40 of the lever unit 4 to swing clockwise to assume an operative position indicated by a phantom line in FIG. 1. When this takes place, the lever ring 42, the caulked ring washer 43 and the ring washer 44 cooperate with each other to axially move the clutch shaft 5 frontward to assume an actuating position indicated by a phantom line. This causes the pinion 53 of the clutch shaft 5 to be brought into meshing engagement with the ring gear 101 of the engine, thereby starting up the engine.

More particularly, during startup of the engine, the motor section 1 generates output torque at a reduced speed due to the presence of the armature gear 14, the planetary gears 21 and the internal gear 24, upon which output torque is transferred to the clutch outer 31 of the clutch 3. When this takes place, the clutch outer 31 transfers torque via the rollers 32 to the clutch inner 33 that transfers torque to the helical spline 35 of the clutch shaft 5 via the helical spline 34. When this takes place, the clutch shaft 5 is pushed toward the ring gear 101 of the engine due to a swinging force of the lever unit 4 and forces of the helical splines 34, 35. This causes the pinion 53, carried on the clutch shaft 5 at the front end thereof, to be brought into meshing engagement with the ring gear 101 of the engine at an actuating position, performing startup of the engine.

Upon startup of the engine, the starter switch is turned off and the electromagnetic switch 7 is de-energized so that the plunger 71 of the electromagnetic switch 7 is restored to its original position. When this takes place, the lever 40 of the lever unit 4 is caused to swing counterclockwise as viewed in FIG. 1, permitting the clutch shaft 5 to restore to the stationary position to stop the starter S.

Next, reference is made to FIG. 5 to describe how a trial assembly is prepared using the planetary reduction gear unit 2, the electromagnetic switch 7 and the lever unit 4 which are mounted to the case 9. As shown in FIG. 5, the electromagnetic switch 7 is fitted to the case 9 such that a movable contact 72 and an insulation bush 73 are fixedly mounted on the plunger 71 while permitting the joint 71*a* to be brought into engagement with the bifurcated head portions 40*a*, 40*a* of the lever unit 4 at the front end of the plunger 71. The plunger 71 carries thereon a return spring 75 for closing or opening the movable contact 72 and the stationary contact 74. Under a status before the front housing 6 is assembled to the case 9, the plunger 71 is held stationary at a forward end position as shown in FIG. 1 by the action of the spring 75. That is, the plunger 71 is moved to an area closer to the engine until the insulation bush 73 and the plate 76, forming a magnetic flux circuit of the electromagnetic switch 7, are brought into abutting engagement with each other.

When assembling the lever unit 4 to the case 9, the lever ring 42 of the lever unit 4 is brought into engagement with the clutch shaft 5 under a condition (see FIG. 5) where the plunger 71 is held stationary at the forward end position. Then, the positioning projections 41*h*, 41*i*, 41*j* of the second positioning member P2 of the lever collar 41 are brought into engagement with the associated positioning depressed portions 9*h*, 9*i*, 9*j* of the first positioning member P1 of the case 9 for positioning the lever collar 41 with respect to the case 9. Then, the bifurcated head portions 40*b* of the lever 40 are brought into engagement with the joint 71*a* of the plunger 71. When this takes place, since the bifurcated portions 40*b*, 40*b* of the lever 40 have been already assembled to the clutch shaft 5 by means of the lever ring 42, no drop-off of the lever 40 takes place during trial assembly. Also, since the lever collar 41 is maintained under a positioned state with respect to the case 9 due to the engagement between the positioning projections 41*h*, 41*i*, 41*j* of the positioning member P2 and the positioning depressed portions 9*h*, 9*i*, 9*j* of the positioning member P1, the lever collar 41 can be smoothly inserted to a lever collar insertion recess 6*b* formed on the front housing 6 at the inner wall thereof.

As will be clearly understood from the foregoing detailed description, with the starter S of the present embodiment, the case 9 has the front end face 9*g*, playing a role as a positioning mount wall formed with the positioning member P1, and the lever collar 41 of the lever unit 4 includes the positioning member P2 engageable with the positioning member P1 of the case 9. Thus, the lever collar 41 of the lever unit 4 can be positioned with respect to the positioning mount wall of the case 9 in a highly reliable manner.

More particularly, the positioning projections 41*h* to 41*j* of the positioning member P2 are formed on the rear end face 41*b* of the lever collar 41 in opposition to the positioning mount wall 9*g* of the case 9. In the meanwhile, the positioning depressed portions 9*h* to 9*j* of the positioning member P1 are formed on the positioning mount wall 9*g* of the case 9 in opposition to the lever collar 41. The positioning projections 41*h* to 41*j* of the positioning member P2 and the positioning depressed portions 9*h* to 9*j* of the positioning member P1 are arranged to engage with each other, enabling the lever collar 41 to be positioned with respect to the positioning mount wall 9*g* of the case 9. Therefore, the lever unit 4 can be easily fitted to the case 9 in a fixed position so as to assist assembling work without causing the lever collar 41 to twist or rotate during assembly of the starter S.

That is, first, the planetary reduction gear unit 2 is accommodated in a reduction gear unit accommodating section 9*a* of the case 9. Then, the plunger 71, the movable contact 72 and a mold cover 77 of the electromagnetic switch 7 are arranged in a preassembled structure, which in turn is received in a switch accommodating section 9*b* of the case 9. Thereafter, the clutch shaft 5 is assembled to the case 9 as the pinion moving body. Next, under a status with the lever collar 41 being assembled to the lever 40, the bifurcated head portions 40*a*, 40*a* of the lever 40 are brought into engagement with the joint 71*a* formed at the distal end of the plunger 71 and protruding from the case 9. Then, the bifurcated leg portions 40*b*, 40*b* of the lever 4 are coupled to the clutch shaft 5 by means of the lever ring 42. Subsequently, the positioning projections 41*h* to 41*j* playing a role as the positioning member P2, formed on the rear surface 41*b* of the lever collar 41 in opposition to the positioning mount wall 9*g* of the case 9, are brought into engagement with the associated positioning depressed portions 9*h* to 9*j* playing a role as the positioning member P1 of the case 9 opposing the lever collar 41. Thus, the lever unit 4 can be assembled to the case 9 under a trial assembly state close to a legitimate assembly status and under such a trial assembly status, the front housing 6 can be easily assembled to the case 9 without causing a drop-off of the lever collar 41 from the case 9.

Further, the lever collar 41 includes the positioning member P2 in the form of the plurality of positioning projections 41*h* to 41*j*. Additionally, the case 9 includes the positioning member P1 in the form of the plurality of positioning depressed portions 9*h* to 9*j* that are engageable with the positioning projections 41*h* to 41*j* of the positioning member P2. Thus, engaging the positioning members P1 and P2 with respect to each other allows the lever collar 41 to be fixedly held at a plurality of engagement points. This blocks the twisting or rotation of the lever collar 41 about the center axis thereof in a highly reliable manner. Accordingly, the lever collar 41 can be maintained under a fixed condition not to result in a twisted attitude, enabling a starter to be assembled in a further easy fashion without troubles.

Furthermore, the positioning projections 41*h* to 41*j* of the positioning member P2 and the positioning depressed portions 9*h* to 9*j* of the positioning member P1 can be maintained in an engagement status under a condition where the plunger 71 remains in the forward end position. This allows the lever unit 4 to be reliably maintained under a trial assembly TA with respect to the case 9, as shown in FIG. 5, even if the one end of the lever 40 engages the joint 71*a* formed at the distal end of the plunger 71 and the other end of the lever 40 is brought into engagement with the clutch shaft 5. Therefore, the trial assembly TA can be reliably sustained with the lever unit 4 fixedly retained in a positioned state with respect to the case 9, thereby providing an ease of assembling the front housing 6 to the trial assembly TA without causing a drop-off of the lever unit 4 from the case 9.

Moreover, engaging the lever 40 and the clutch shaft 5 with each other via the lever ring 42 allows the inner wall of the lever ring 42 to be brought into abutting engagement with the clutch shaft 5 under a condition with no need for the plunger 71 to be moved to the forward end position. This enables a reduction in the amount of lift of the lever collar 41 from the front end face 9*g* of the case 9, thereby shortening an engagement length between the positioning projections 41*h* to 41*j* and the positioning depressed portions 9*h* to 9*j* for achieving the positioning between the lever collar 41 and the case 9. Therefore, no disengagement takes place between the lever 4 and the clutch shaft 5 during assembling work, providing further improved assembling workability of a starter.

Additionally, due to the provision of the lever collar insertion recess 6*b* on the inner wall of the front housing 6 for positioning and inserting the lever collar 41, the lever collar 41 can be inserted to the lever collar insertion recess 6*b* to be positioned with respect to the front housing 6 in a highly reliable manner in addition to the advantageous effect of the lever collar 41 positioned with respect to the case 9 through engagement between the positioning projections 41*h* to 41*j* and the positioning depressed portions 9*h* to 9*j*.

While the present invention has been described with reference to a structure wherein the positioning projections 41*h* to 41*j* are formed on the lever collar 41 and the positioning depressed portions 9*h* to 9*j* are formed on the case 9, an alternative may take the form of a structure wherein the positioning depressed portions are formed on the lever collar 41 whereas the positioning projections are formed on the case 9. Basically, the positioning projections may be formed on one of the surfaces of the lever collar 41 and the case 9 and the positioning depressed portions may be formed on the other one of the surfaces of the lever collar 41 and the case 9. That is, the lever collar 41 and the case 9 may be formed with first and second engageable positioning components, respectively, which play as roles as first and second positioning means taking the form of either the positioning projections or the positioning depressed portions.

Further, while the present invention has been described above with reference to a structure wherein the plurality of positioning projections 41*h* to 41*j* each with a circular shape in cross section are formed on the lever collar 41 and the plurality of positioning depressed portions 9*h* to 9*j* each with a circular shape in cross section are formed on the case 9 for thereby limiting the rotation of the lever collar 41 about the center axis thereof, an alternative may take the form of a structure wherein the positioning projections and the positioning depressed portions have non-circular shapes (such as polygonal shapes or the like) in cross section. Forming the positioning projections and the positioning depressed portions in non-circular shapes in cross section enables the formations of one of the positioning projections and one of the positioning depressed portions. Even with such a structure, the lever collar 41 can be restricted so as not to rotate about the center axis of the lever collar 41.

With such a starter of the two-shaft structure wherein the rotary shaft of the motor section and the actuating plunger of the electromagnetic switch are placed in parallel to each other, the case has the reduction gear unit accommodating section for receiving the reduction gear section and the switch accommodating section for receiving the electromagnetic switch. With such a structure, the lever collar and the case can be easily positioned with respect to each other by means of a positioning mechanism, thereby providing improved assembling workability of the lever that interconnect the actuating plunger of the electromagnetic switch and the pinion moving body to which torque is transferred from the reduction gear section and which shifts the pinion toward the ring gear of the engine.

Also, while the specific embodiment of the present invention has been described above in detail, it will be appreciated by those skilled in the art that various modifications and alternatives could be developed in light of the overall teachings of the disclosure. Accordingly, the particular arrangement disclosed is meant to be illustrative only and not limited to the scope of the present invention, which is to be given the full breadth of the following claims and all equivalents thereof.

What is claimed is:

1. A starter for starting up an engine having a ring gear, comprising:

a case formed in a unitary structure having a reduction gear unit accommodating section, receiving therein a reduction gear section operative to reduce a rotational speed of a motor, and a switch accommodating section, receiving therein an electromagnetic switch having a plunger whose front end protrudes from the case;

a housing supporting the case such that the case is sandwiched between the housing and the motor;

a lever unit including a lever, having one end held in engagement with the front end of the plunger, and a lever support member mounted on the case for swingably supporting the lever, the lever unit being actuated by the electromagnetic switch to selectively move the lever in inoperative and operative positions; and a pinion moving body carrying thereon a pinion and held in engagement with the other end of the lever to be actuated by the lever unit when the electromagnetic switch is operated to allow the pinion to be brought into meshing engagement with the ring gear of the engine to transfer an output torque of the reduction gear section to the ring gear for thereby starting up the engine; and wherein one of opposing surfaces of the lever support member and the case has at least one positioning projection and the other one of the opposing surfaces of the lever support member and the case has at least one positioning depressed portion with which the positioning projection engages to allow the lever support member to be positioned with respect to the case.

2. The starter according to claim 1, wherein:

the positioning projection and the positioning depressed portion are operative to restrict the lever support member from rotating about a center axis thereof.

3. The starter according to claim 2, wherein:

the positioning projection comprises a plurality of positioning components, formed on the one of the opposing surfaces of the lever support member and the case, and the positioning depressed portion comprises a plurality of depressed components, formed on the other one of the opposing surfaces of the lever support member and the case, which are engageable with the plurality of positioning components, respectively.

4. The starter according to claim 1, wherein:

the electromagnetic switch further includes a fixed plate for forming a magnetic flux circuit of the electromagnetic switch, and a movable contact and an insulation bush both of which are mounted on the plunger; and when the plunger is at a forward end position, the positioning projection and the positioning depressed portion are in engagement with each other and the fixed plate and the insulation bush are in abutment with each other.

5. The starter according to claim 1, wherein:

the lever unit further includes an annular engagement member through which the lever is coupled to the pinion moving body.

6. The starter according to claim 1, wherein:

the housing has an inner wall formed with an insertion recess to which the lever support member is inserted for positioning the lever support member in a fixed place.

7. A starter for starting up an engine having a ring gear, comprising:

a case formed in a unitary structure having a reduction gear unit accommodating section, receiving therein a reduction gear section operative to reduce a rotational speed of a motor, and a switch accommodating section, receiving therein an electromagnetic switch having a plunger whose front end protrudes from the case;

a housing supporting the case such that the case is sandwiched between the housing and the motor;

a lever unit including a lever, having one end held in engagement with the front end of the plunger, and a lever support member mounted on the case for swingably supporting the lever, the lever unit being actuated by the electromagnetic switch to selectively move the lever in inoperative and operative positions;

a pinion moving body carrying thereon a pinion and held in engagement with the other end of the lever to be actuated by the lever unit when the electromagnetic switch is operated to allow the pinion to be brought into meshing engagement with the ring gear of the engine to transfer an output torque of the reduction gear section to the ring gear for thereby starting up the engine; and a positioning mechanism disposed between the lever support member and the case to maintain the lever support member on the case in a predetermined positioned status.

8. The starter according to claim 7, wherein:

the case includes a positioning mount wall in opposition to the lever support member; and the positioning mechanism comprises a first positioning member, disposed on the lever support member, and a second positioning member, disposed on the positioning mount wall of the case, with the first and second positioning members being held in engagement with each other for positioning the lever support member with respect to the positioning mount wall of the case.

9. The starter according to claim 8, wherein:

the first positioning member comprises at least one positioning projection and the second positioning member comprises at least one positioning depressed portion with which the at least one positioning projection engages.

10. The starter according to claim 7, wherein:

the positioning mechanism allows the lever support member and the case to be held in an engagement state under a condition where the plunger of the electromagnetic switch protrudes to a forward end position.

11. The starter according to claim 7, wherein:

the positioning mechanism allows the lever support member and the case to be held in an engagement state under a condition where the plunger of the electromagnetic switch protrudes to a forward end position in engagement with one end of the lever and the other end of the lever is held in engagement with the pinion moving body.

12. A starter for starting up an engine having a ring gear, comprising:

a case having a unitary structure formed with a reduction gear unit accommodating section, receiving therein a reduction gear section operative to reduce a rotational speed of a motor, and a switch accommodating section receiving therein an electromagnetic switch including a plunger having a front end protruding forward from the case;

a housing disposed in front of the case so as to sandwich the case between the housing and the motor;

a lever unit including a lever, having one end held in engagement with the front end of the plunger in an area between the case and the housing, and a lever support member mounted on the case for swingably supporting the lever, the lever unit being operative to selectively move the lever in inoperative and operative positions;

a pinion moving body, carrying thereon a pinion, which is held in engagement with the other end of the lever and operative to axially move when the electromagnetic switch is operated to allow the pinion to be brought into meshing engagement with the ring gear of the engine to transfer an output torque of the reduction gear section to the ring gear for thereby starting up the engine; and a first positioning element provided on the lever support member at a rear end face thereof; and a second positioning element provided on the case at a surface facing the rear end face of the lever support member;

wherein the first and second positioning elements are held in engagement with each other to maintain the lever support member on the case in a positioned status.

13. A starter for starting up an engine having a ring gear, comprising:

case means having a unitary structure formed with a reduction gear unit accommodating section, receiving therein a reduction gear section operative to reduce a rotational speed of a motor, and a switch accommodating section receiving therein an electromagnetic switch including a plunger having a front end protruding forward from the case means;

housing means disposed in front of the case means so as to sandwich the case means between the housing means and the motor;

a lever unit including a lever, having one end held in engagement with the front end of the plunger in an area between the case means and the housing means, and a lever support member mounted on the case for swingably supporting the lever, the lever unit being operative to selectively move the lever in inoperative and operative positions;

a pinion moving body, carrying thereon a pinion, which is held in engagement with the other end of the lever and operative to axially move when the electromagnetic switch is operated to allow the pinion to be brought into meshing engagement with the ring gear of the engine to transfer an output torque of the reduction gear section to the ring gear for thereby starting up the engine; and first positioning means provided on the lever support member at a rear end face thereof; and second positioning means provided on the case at a surface facing the rear end face of the lever support member;

wherein the first and second positioning means are held in engagement with each other to maintain the lever support member on the case in a fixedly positioned status.

* * * * *